US005803479A

United States Patent [19]

Meyer et al.

[11] Patent Number: 5,803,479

[45] Date of Patent: Sep. 8, 1998

[54] FIELD-ADJUSTABLE LOAD-ABSORBING SKI

[75] Inventors: Hans Meyer, Munich; Lothar Meyer, Vaterstetten, both of Germany

[73] Assignee: Dural, Inc., Cumming, Ga.

[21] Appl. No.: 562,473

[22] Filed: Nov. 24, 1995

[30] Foreign Application Priority Data

Nov. 25, 1994 [DE] Germany ..... 44 42 095.1

[51] Int. Cl.[6] ..... A63C 9/00

[52] U.S. Cl. ..... 280/607; 280/602

[58] Field of Search ..... 280/607, 601, 280/617, 618, 633, 602

[56] References Cited

U.S. PATENT DOCUMENTS

| | | | |
|---|---|---|---|
| 5,242,188 | 9/1993 | Biglar | 280/607 |
| 5,366,234 | 11/1994 | Rohrmoser | 280/607 |
| 5,538,271 | 7/1996 | Abondance | 280/607 |

FOREIGN PATENT DOCUMENTS

P3712807.8-15 11/1988 Germany .

*Primary Examiner*—Richard M. Camby
*Attorney, Agent, or Firm*—Kennedy, Davis & Kennedy

[57] ABSTRACT

A field-adjustable load-absorbing spring plate for skis, which spring plate pivotally mounts to an upper surface of a ski for relative vertical movement of the spring plate in response to inflation of an air bladder disposed between the upper surface of the ski and the spring plate and in response to loads imposed on the ski by the skier while skiing. An air pump connects by an air pipe to the air bladder and a valve operatively connected between the air pump and the air pipe is movable between a closed position and an open position the valve is selectively operable for communicating air under pressure from the pump into the air bladder and for communicating air from the air bladder to atmosphere. Side wallls extend downwardly on opposite longitudinal sides of the spring plate for holding the air bag in position between the ski and the spring plate. Spaced-apart lines in a surface of a forward hinge plate covered or uncovered by a measuring plate as the hinge plate moves in response to changing the pressure of air in the air bladder to provide a relative measure of the pressurization of the air bladder. An opening defined in a rear portion of the spring plate communicates snow from around the air bladder outwardly of the ski.

7 Claims, 1 Drawing Sheet

FIELD-ADJUSTABLE LOAD-ABSORBING SKI

TECHNICAL FIELD

The present invention relates generally to skis. More particularly, the present invention relates to load-absorbing spring plates for skis, which are adjustable in the field to change the load absorbed while skiing.

BACKGROUND OF THE INVENTION

Downhill snow skiing is a popular winter sport. The skier wears a pair of skis that attach with bindings to the boots of the skier. The skies support the skier traversing the snow-covered slopes. During such, the skier experiences loading that arises from bounces, shocks, and jostling as the skier moves over the surface of the snow. This activity particularly puts stress on the legs, knees, and back of the skier. Cushioning devices have been provided in order to absorb or reduce the shocks and bounces experienced by skiers while skiing. Rubber pads disposed between the binding and the ski are to provide a cushioning effect. While these pads tend to reduce or dampen somewhat the forces experienced by the skier, there are limitations and drawbacks to their use. The rubber pads tend to stiffen and lose resiliency necessary for absorbing shocks. Also the cushioning effect is not adjustable by the skier for accomodating personal preferences.

German patent P 37 12 807.8 describes a spring plate that mounts on top of the middle part of a ski. An air bladder is disposed between the ski and the spring plate. The air bladder is pressurized by an external pump. The air bladder cushions the forces on the skier while skiing. The spring plate moves vertically relative the ski during skiing, and presses against the air bladder which absorbs the loading imposed by the skier. The cushioning air bladder accordingly reduces the stress imposed on the legs, knee, and back of the skier.

While the air bladder generally reduces stress loading, there are drawbacks which limit its usefulness. The skier has either to carry an external pump or to use a vendor-supplied pump at the ski run for the individual adjustment of the hardness of the air bladder and the moveable distance of the spring plate relative the ski, which is adjusted by changing the air pressure in the air bladder. Further, it is difficult for the skier to gauge the pressurization which is appropriate, depending upon the weight of the skier, experience, and individual preferences for the amount of cushion desired. Changes in altitude affect the pressurization in the air bladder. An appropriate pressure at a lower elevation may be entirely insufficient at a higher elevation. Also, snow tends to build up around the air bladder between the ski and the spring plate. The built-up snow packs together. The packed snow hardens and restricts the vertical movement of the spring plate during skiing. The cushioning effect may be lost thereby to the skier. Finally, the air bladders are susceptible to lateral displacement from between the spring plate and the ski.

Accordingly, there is a need in the art for an improved load-absorbing spring plate for skis that is more easily adjusted in the field for varying loads with a readily usable gauge for the skier to set an appropriate pressurization, while preventing the packing of snow and displacement of the air bladder during skiing. It is to the provision of such that the present invention is primary directed.

SUMMARY OF THE INVENTION

The present invention meets the need in the art by providing a field-adjustable load-absorbing spring plate for skis, comprising a ski with a spring plate mounted to an upper surface. The spring plate pivotally mounts with a rear base hinge and a forward base hinge to relative vertical movement of the spring plate in response to inflation of an air bladder disposed between the upper surface of the ski and the spring plate and in response to loads imposed on the ski by the skier while skiing. An air pump connects by an air pipe to the air bladder and a valve operatively connected between the air pump and the air pipe is movable between a closed position and an open position for communicating air. In the open position the valve can be operated selectively for communicating air under pressure from the pump into the air bladder or communicating air from the air bladder to the atmosphere. The skier, by selectively operating the valve, increases the pressure of the air bladder or vents air from the bladder to the atmosphere, for absorbing loads imposed on the skier during skiing The load-absorbing ski further includes a pair of side members that extend downwardly on opposite longitudinal sides of the spring plate for holding the air bag in position between the ski and the spring plate. A surface of the forward hinge plate includes a plurality of spaced-apart lines that are covered or uncovered by an edge of a fixed measuring plate as the hinge plate moves in response to changing the pressure of air in the air bladder. This provides a relative measure of the pressurization of the air bladder. A plurality of openings defined in a rear portion of the spring plate communicates snow from around the air bladder outwardly of the ski.

DETAILED DESCRIPTION

Figure 1:
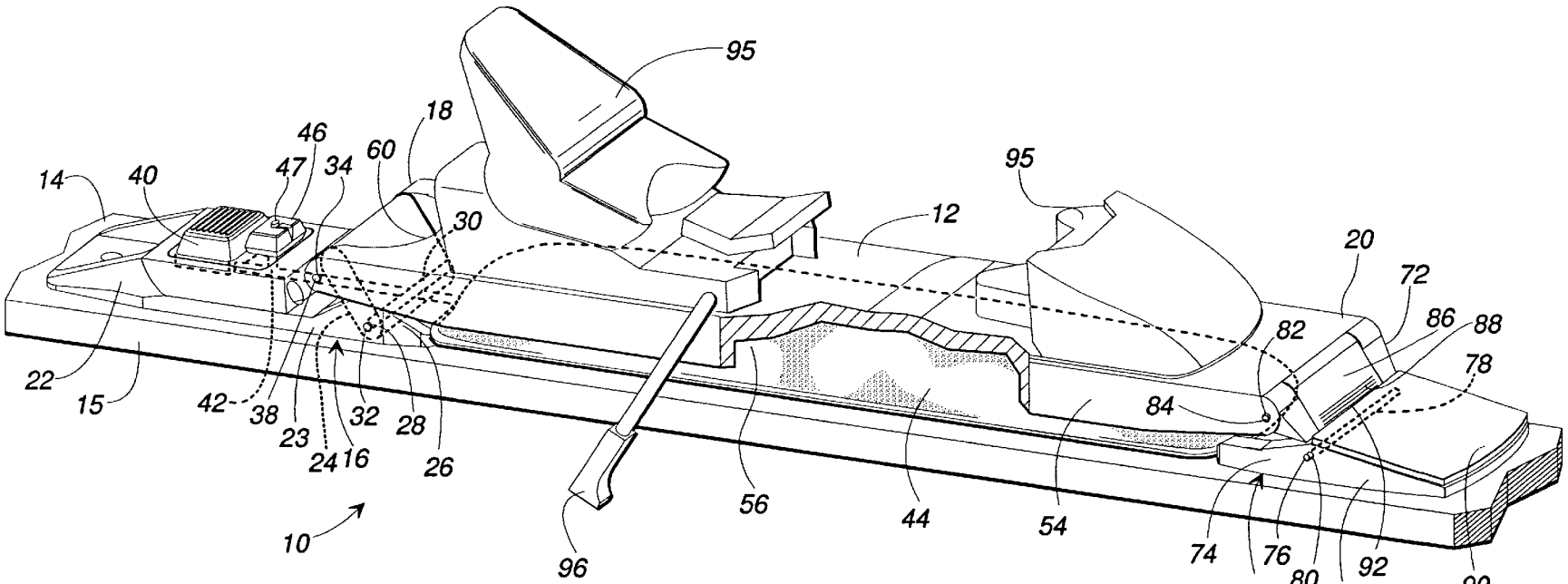
FIG. 1 is a perspective view of a load-absorbing ski according to the present invention.

Referring now in more detail to FIG. 1 which shows a perspective partially cut-away view of a load-absorbing ski 10 according to the present invention. A spring plate 12 mounts to an upper surface 14 of a ski 15 with a pair of base hinges 16, 17 which connect at a rear end 18 and a forward end 20, respectively, of the spring plate 12. The rear base hinge 16 has a rear spoiler generally designated 22, a base element 23, and a hinge plate 24 that pivotally connects the base element to the rear 18 of the spring plate 12. The base element 23 connects to the ski 15 with screws. The base element 23 includes a pair of spaced-apart flanges 26 (one of which is illustrated) that each define a bore 28. The hinge plate 24 has a first channel 30 that axially aligns with the bores 28 for receiving a pin 32 therethrough for pivotally connecting the hinge plate to the base element 23. A second channel in an opposite edge of the hinge plate 24 coaxially aligns with bores 34 in the rear portion of the spring plate 12. The bores 34 and the second channel 32 receive a pin 38 for pivotally connecting the hinge plate 24 to the spring plate 12.

The rear spoiler 22 receives an elastic pump 40 that comprises a resilient bulb that projects outwardly. An air pipe 42 connects the pump 40 to a resilient air bladder 44 which is disposed between the spring plate 12 and the ski 10. A valve 46 connects in-line with the air pipe 42. In the illustrated embodiment, the valve 46 has a rotatable cap for locking and unlocking the valve from a closed position to an open position for communicating air through the air pipe 42. The valve 46 is selectively operable in the open position for communicating air under pressure from the pump 40 to the air bladder 44 and for venting air from the air bladder 44 to the atmosphere. In the illustrated embodiment, the valve is biased in a first operating position for comminucating air to the bladder. The second operating position is effected by displacing a spring-biased piston 47 from the first operating position to a second operating position. In the first operating position, the air in the air pipe 42 is communicated to the air bladder 44. With the piston 47 in the second operating position, the air in the air bladder 44 vents through the air pipe to the atmosphere. In an alternate embodiment (not illustrated), the pump 40 is disposed in the base hinge 17 at the forward end of the ski.

A strap (not illustrated) connects between the base element 23 and the pin 38 for limiting the maximum vertical movement of the spring plate 12 upon pressurizing the air bladder 44, as discussed below.

The spring plate 12 includes a pair of side members 54 on opposite sides of the ski. The side members 54 extend downwardly from the spring plate 12 and cooperatively define a recess generally designated 56 under the spring plate 12 for receiving the air bladder 44. Further, the side members 54 restrict lateral displacement of the air bladder 44 from under the spring plate 12.

The rear portion 18 of the spring plate 12 and the hinge plate 24 define an opening 60 for passage of snow from the recess 56 during skiing.

The base hinge 17 at the forward end 20 of the spring plate 12 mounts with screws to the ski 12. The base hinge 17 includes a base element 70 and a hinge plate 72 that pivotally connects the base element 70 to the forward 20 end of the spring plate. A pair of spaced-apart flanges 74 (one of which is illustrated) define bores 76 which coaxially align with a channel 78 in the hinge plate. The bores 76 and the channel 78 receive a pin 80 for pivotally connecting the hinge plate 72 to the base element 70. A second channel along an opposite edge of the hinge plate 72 coaxially aligns with bores 82 in the forward end 18 of the spring plate 12. The bores 82 and the second channel receive a pin 84 for pivotally connecting the hinge plate 72 to the spring plate 12. A strap (not illustrated) connects between the base element 70 and the pin 84 for limiting the maximum vertical movement of the spring plate 12 upon pressurizing the air bladder 44, as discussed below. A facing surface 86 of the hinge plate 72 defines a plurality of spaced-apart lines 88. A measuring plate 90 is fixed to a forward portion of the base hinge 17, and an edge 92 extends over the facing surface 86. The edge 86 covers the lines 88 and provides an indication of the pressurization of the air bladder 44 by the relative movement of the forward hinge plate in response to a change in the pressure in the air bladder. As the hinge plate pivots, the number of lines 88 covered by edge 92 of the measuring plate 92 changes.

A ski binding generally designated 95 conventionally mounts to the upper surface 14 of the spring plate. A ski stopper 96 extends outwardly of the binding for conventionally stopping a ski if it becomes separated from the skier.

The improved ski 10 of the present invention is secured with the binding 95 to the boot of the skier. The valve 46 is moved from the closed position to the first open position. The skier stands to apply weight downwardly on the ski 15. The pump 40 is pressed repeatedly and forcefully. This pumps air under pressure through the air pipe 42 into the air bladder 44. As the air bladder 44 becomes pressurized, the air bladder inflates. In response, the spring plate 12 moves vertically relative to the ski 15 as the hinge plates 24 and 72 pivot on their respective pin connections. The straps described above prevent the spring plate 12 from exceeding a pre-determined maximum vertical movement.

As the spring plate 12 moves, the edge 92 of the measuring plate 90 covers more of the lines 88. The skier observes the change in the number of exposed lines, until a relative index of the pressurization appropriate for the skier is reached. The valve 46 is then moved to the closed position.

During skiing, the shocks and loading imposed by the skier are absorbed by the air bladder, and the stress imposed on the skier is reduced. The spring plate 12 moves relative to the ski 15 cushioned by the pressurized air bladder 44. This cushioning dampens and absorbs the shocks and loading, thereby reducing stress forces on the legs, knees, and back of the skier.

The valve 46 is opened to the open position to repressurize the air bladder 44 as necessary. For example, a skier reaching an upper elevation from a lower elevation may then repressurize the air bladder 44 as discussed above. During skiing, the air bladder 44 cushions the loading on the skier as the spring plate moves relative the ski 15 against the air bladder 44. To reduce the pressure in the air bladder 44, the valve 46 is opened and selectively operated to vent air. In the illustrated embodiment, the valve 46 is opened, and the piston 47 is actuated to move from its biased first operating position to the second operating position. Air in the bladder 44 exits the valve 46. The skier observes the relative number of lines 88 visible from the edge 92 to set the air bladder 44 at the appropriate pressurization for the skier.

During skiing, snow may enter from the longitudinal sides into the recess 56. The opening 60 in the spring plate 12 allow the snow to communicate from the recess 56 outwardly of the ski 10. This reduces the build-up and packing of snow in the recess 56, and thereby avoids the problem of being unable to pressurize the air bladder 44 to a desired pressure and the problem of blocking the air bladder from properly absorbing shocks and loading during skiing.

The foregoing has disclosed an improved spring plate for skis, which is field adjustable to change the load-absorption capability of the ski during skiing. It should be understood that the above-described embodiments merely illustrate principles of the invention in preferred forms. Many modifications, additions, and deletions may come of course, be made thereto without departure from the spirit and scope of the invention as set forth in the following claims.

What is claimed is:

1. A field-adjustable load-absorbing ski, comprising:

a ski;

a spring plate mounted by a rear base hinge and a forward base hinge to an upper surface of the ski for vertical movement of the spring plate relative to the ski;

an air bladder disposed between the upper surface of the ski and the spring plate;

an air pump attached to said ski, said air pump connected by an air pipe to the air bladder;

a valve operatively connected between the air pump and the air pipe, the valve movable between a closed position and an open position and selectively operable in the open position for communicating air under pressure from the pump into the air bladder and for communicating air from the air bladder to the atmosphere, whereby the skier, by selectively operating the open valve, adjusts the pressure of the air bladder which absorbs loads imposed on the skier during skiing.

2. The load-absorbing ski as recited in claim 1, wherein the spring plate includes a pair of side members that extend downwardly on opposite longitudinal sides of the spring plate for holding the air bag in position between the ski and the spring plate.

3. The load-absorbing ski as recited in claim 1, further comprising a measuring plate fixed on the forward hinge plate; and wherein the forward hinge plate defines a plurality of spaced apart lines on a surface facing the measuring plate, whereby the relative movement of the forward hinge plate in response to a change in the pressure in the air bladder changes the number of lines covered by a facing edge of the measuring plate.

4. The load-absorbing ski as recited in claim 1, wherein the spring plate defines openings in rearward portions thereof for communicating snow from around the air bladder outwardly of the ski.

5. A load-absorbing ski, comprising:

a ski;

a spring plate mounted by a rear base hinge and a forward base hinge to an upper surface of the ski for vertical movement of the spring plate relative to the ski, and having side walls that extend downwardly on opposing longitudinal sides for defining a recess between an upper surface of the ski and the spring plate;

an air bladder disposed in the recess between the upper surface of the ski and the spring plate and restrained therein by the side walls;

an air pump attached to said ski, said air pump connected by an air pipe to the air bladder;

a valve operatively connected between the air pump and the air pipe, the valve movable between a closed position and an open position and selectively operable for communicating air under pressure from the pump into the air bladder and for communicating air from the air bladder to the atmosphere, whereby the skier, by selectively opening the valve, adjusts the pressure of the air bladder which absorbs loads imposed on the skier during skiing.

6. The load-absorbing ski as recited in claim 5, further comprising a measuring plate fixed on the forward hinge plate; and wherein the forward hinge plate defines a plurality of spaced apart lines on a surface facing the measuring plate, whereby the relative movement of the forward hinge plate in response to a change in the pressure in the air bladder changes the number of lines covered by a facing edge of the measuring plate.

7. The load-absorbing ski as recited in claim 6, wherein the spring plate defines at leasts one opening in a rearward portion thereof for communicating snow from around the air bladder outwardly of the ski.

* * * * *